United States Patent [19]

Urban

[11] 4,401,550

[45] Aug. 30, 1983

[54] LIQUEFACTION OF CALCIUM-CONTAINING COALS

[75] Inventor: Peter Urban, Northbrook, Ill.

[73] Assignee: UOP Inc., Des Plaines, Ill.

[21] Appl. No.: 338,737

[22] Filed: Jan. 11, 1982

[51] Int. Cl.[3] ..... C10G 1/00; C10L 1/04

[52] U.S. Cl. ..... 208/8 LE; 44/1 SR

[58] Field of Search ..... 208/8 LE; 44/1 SR

[56] References Cited

U.S. PATENT DOCUMENTS

| | | | |
|---|---|---|---|
| 700,485 | 1/1968 | Hemminger | 208/8 LE |
| 1,436,289 | 11/1922 | Plauson | 208/8 LE |
| 4,161,440 | 7/1979 | Brunson | 208/8 R |
| 4,206,033 | 6/1980 | Meanel et al. | 208/8 LE |
| 4,304,655 | 12/1981 | Poddar | 208/8 LE |
| 4,322,283 | 3/1982 | Maa et al. | 208/8 LE X |
| 4,332,666 | 6/1982 | Bauman et al. | 208/8 LE |

*Primary Examiner*—Delbert E. Gantz
*Assistant Examiner*—William G. Wright
*Attorney, Agent, or Firm*—James R. Hoatson, Jr.; John G. Cutts, Jr.; William H. Page, II

[57] ABSTRACT

A process for liquefying a calcium-containing coal which comprises contacting calcium-containing coal with an aqueous sulfur oxide solution. The resulting admixture is contacted with hydrogen sulfide to produce water soluble thiosulfate. After the treated coal is separated from the resulting aqueous phase, the coal is charged to a coal liquefaction zone.

19 Claims, No Drawings

LIQUEFACTION OF CALCIUM-CONTAINING COALS

BACKGROUND OF THE INVENTION

The present invention relates to the liquefaction of coal. During the conversion or liquefaction of coal which contains calcium, calcium carbonate scale normally forms on the surfaces of the coal liquefaction reactor, lines, auxiliary equipment and the like. The scale is extremely troublesome while attempting to obtain long continuous runs of the liquefaction process because eventually the flow through the narrowest sections of the plant is drastically impeded or closed. Therefore, it is essential that calcium and the like foulants be rendered innocuous if a successful coal conversion process is desired. The present invention proposes to solve the carbonate scale deposition problem.

U.S. Pat. No. 4,161,440 (Brunson), teaches a method to minimize the formation of scale during coal liquefaction by adding sulfur oxide with the coal prior to liquefaction to form a molecular species which deposits within the pores of the coal. This resulting molecular species is thermally stable and does not decompose at liquefaction conditions, and during liquefaction remains as particulate solids and thereby does not form or at least suppresses the formation of scale, or calcium carbonate deposits. The insoluble form of calcium remains within the liquefaction bottoms, or ash, and is conveniently disposed of, after liquefaction, with the liquefaction bottoms.

Although the process of U.S. Pat. No. 4,161,440 (Brunson) reduces the formation of scale in the coal liquefaction zone, the quantity of ash which must be ultimately separated from the desirable products of the liquefaction is increased. Separation of ash is a large and difficult task associated with the liquefaction of coal, and any effort to minimize the quantity of ash to be separated is advantageous. My invention converts ash precursors in contra-distinction to U.S. Pat. No. 4,161,440 (Brunson) to water soluble compounds which may easily be separated before the liquefaction of the coal.

BRIEF SUMMARY OF THE INVENTION

It is a broad objective of my process to make available an improved method for the liquefaction of calcium-containing coal.

A preferred embodiment of my invention is a process for liquefying a calcium-containing coal which comprises: (a) contacting the coal with an aqueous sulfur oxide solution; (b) contacting the coal, water and resulting calcium sulfite from step (a) with hydrogen sulfide to produce water soluble thiosulfate; (c) recovering coal by removing an aqueous solution of calcium thiosulfate; and (d) liquefying the coal from step (c) in a coal liquefaction zone.

Another preferred embodiment of my invention is a process for liquefying a calcium-containing coal which comprises: (a) contacting the coal with an aqueous sulfur oxide solution and a comminuting agent; (b) contacting the comminuted coal, water and resulting calcium sulfite from step (a) with hydrogen sulfide to produce water soluble thiosulfate; (c) recovering a comminuted coal by removing an aqueous solution of calcium thiosulfate; and (d) liquefying the comminuted coal from step (c) in a coal liquefaction zone.

Other objectives and embodiments of my invention encompass details about coal types, reagents, and reaction conditions, all of which are hereinafter disclosed in the following discussion of each of the facets of the invention.

DESCRIPTION OF THE INVENTION

The present invention contemplates utilizing a subbituminous or lower rank undried, or raw coal. The process of the present invention is preferably employed when processing calcium-containing coal. The coal is sized to obtain coal particles having diameters less than about 5 inches in nominal diameter, more preferably less than one inch. In the past, conventional coal liquefaction processes required that the coal be present in size ranging from about 20 to 8 mesh or smaller. In one embodiment of my invention the expense of further size reduction by permitting the use of larger size coal is eliminated.

According to one embodiment of the present invention, the coal is contacted with an aqueous sulfur oxide solution to form calcium sulfite. The preferred sulfur oxide is sulfur dioxide. The contacting of the coal with the aqueous sulfur oxide solution is performed in any suitable and convenient method and is preferably conducted at a pressure ranging from about 0 to about 3000 psig for a period at least about 0.01 to about 24 hours. The period of contact is preferably conducted at a temperature ranging from about 32° F. to about 200° F. The quantity of sulfur oxide supplied must be sufficient to effectively convert essentially all of the calcium and any other potential scale precursors to the corresponding sulfite. It is preferred that the volume ratio of the aqueous sulfur oxide solution to said coal is from about 1 to about 10.

According to another embodiment of the present invention, the coal is contacted with a comminuting agent which yields coal particles which are suitable for the subsequent liquefaction step. The comminuting agent is preferably employed in amounts from about 1 to about 500 weight percent of the coal, under a pressure ranging from 0 to about 3,000 psig, for a period at least about 0.01 to about 24 hours and at a temperature ranging from about 32° F. to about 200° F. Suitable comminuting agents are those compounds which demonstrate the ability to chemically induce breakage of coal, characterized by nearly forceless comminuting. Preferred comminuting agents are ammonia, sodium hydroxide, methanol, isopropanol, glacial acetic acid, ethylamine, methylamine, acetone, hydrogen peroxide and mixtures thereof. This embodiment of the present invention incorporates what is known as chemical comminution of coal rather than the conventional physical diminution of the coal particles. Chemical comminution involves the chemically induced breakage of coal and is characterized by nearly forceless comminuting. There is no effect on the mineral constituents, which are weakly bonded to the coal. In essence, the process involves the rapid migration of certain low-molecular-weight compounds through the naturally occurring fault systems in the coal. The chemical compounds appear to induce breakage selectively along those boundaries previously weakened by the infiltration of mineral constituents, primarily pyrites and ash. The chemical comminution performs no significant dissolution of the coal itself but provides fragmented coal, liberated from entrained pyrites and ash. Concurrently with the contacting of the coal with a comminuting agent, the coal is contacted with an aqueous sulfur oxide solution to form calcium sulfite. The preferred sulfur oxide is sulfur dioxide. The contacting of the coal with the aqueous sulfur oxide solution is performed in any suitable and convenient method and is preferably conducted at a pressure ranging from about 0 to about 3,000 psig for a period at least about 0.01 to about 24 hours. The period of contact is preferably conducted at a temperature ranging from about 32° F. to about 200° F. The quantity of sulfur oxide supplied must be sufficient to effectively convert essentially all of the calcium and any other potential scale precursors to the corresponding sulfite. It is preferred that the volume ratio of the aqueous sulfur oxide solution to said coal is from about 1 to about 10.

In each of hereinbefore described preferred embodiments, the resulting treated coal together with the attendant calcium sulfite is then contacted with hydrogen sulfide to produce water soluble thiosulfate. This contacting step may also be performed in any suitable and convenient method and is preferably conducted at a pressure ranging from about 0 to about 3,000 psig for a period at least about 0.01 to about 24 hours. The period of contact is preferably conducted at a temperature ranging from about 32° F. to about 200° F. At least stoichiometric quantities of hydrogen sulfide are preferred.

After the coal is sequentially contacted with the aqueous sulfur oxide solution and the hydrogen sulfide, the resulting aqueous solution of calcium thiosulfate is decanted or otherwise removed in any suitable and convenient method. The resulting coal stream may optionally be dried wherein any entrained water, unreacted sulfur oxide and hydrogen sulfide is removed by heating at a temperature ranging from about 200° F. to about 300° F., preferably from about 210° F. to about 230° F. and at pressures ranging from about 0 to about 50 psig, preferably from about 0 to about 15 psig.

After the hereinabove decribed treatment, the coal is then introduced to a coal liquefaction conversion zone. Within the coal liquefaction zone, liquefaction conditions include a temperature ranging from about 500° F. to about 850° F., with pressures ranging from about 100 psig to about 3,500 psig, preferably from about 800 psig to about 3,000 psig. Preferably, molecular hydrogen is also added to the liquefaction zone at a rate from about 1 to about 10 weight percent on a moisture and ash-free coal basis. Liquid residence times ranging from about 5 to about 200 minutes, and preferably from about 10 to about 150 minutes, may be employed. Additionally, the liquefaction zone may receive a recycle stream comprising hydrocarbon solvent, unreacted coal, ash or mixtures thereof which stream is derived from the liquefaction zone effluent.

The effluent from the liquefaction zone consists of gases and liquids, the liquids comprising a mixture of hydrocarbon solvent, dissolved coal, undissolved coal and mineral matter or ash. The product thus includes petroleum-like liquids boiling below about 1000° F. and heavier products. The heavy products, or "liquefaction bottoms" consist of organic hydrocarbons boiling at greater than 1000° F., and inorganic, carbon residue. This bottoms material contains about 60–70 weight percent carbon, and about 20 weight percent ash and is less useful than the 1000° F.-minus hydrocarbon liquid and generally contains 40–50 weight percent of the original feed coal to the process.

The present invention may employ a hydrogenation catalyst in the liquefaction zone which catalyst may be supported or unsupported. Suitable hydrogenation catalysts are known in the art and are conventional for coal liquefaction. Typically, supported catalysts comprise an alumina or silica-alumina support carrying one or more Group VIII non-noble or iron group metals and one or more Group VI-B metals of the Periodic Table. In particular, combinations of one or more Group VI-B metal oxides or sulfides with one or more Group VIII metal oxides or sulfides are preferred. Typical catalyst metal combinations include oxides and/or sulfides of cobalt-molybdenum, nickel-molybdenum, nickel-tungsten, nickel-molybdenum-tungsten, cobalt-nickel-molybdenum and the like. Methods for the preparation of these catalysts are well known in the art. The active metals can be added to the support or carrier, typically alumina, by impregnation from aqueous solutions followed by drying and calcining to activate the composition. Suitable carriers include, for example, activated alumina, activated alumina-silica, zirconia, titania, etc., and mixtures thereof. Activated clays, such as bauxite, bentonite, and montmorillonite, can also be employed. The hereinafter mentioned metals and their oxides or sulfides may be employed as unsupported catalysts and are generally finely divided and dispersed in the reactants. The catalyst concentration generally ranges from about 0.01 to about 10 weight percent metal preferably from about 0.1 to about 5 weight percent metal based on the weight of the coal.

A preferred embodiment of the present invention is further exemplified by the following illustrative embodiment. This illustration is not present to unduly limit the process of this invention but to further demonstrate the hereinabove teachings.

ILLUSTRATIVE EMBODIMENT

A 100 gram portion of Wyodak coal (or Arkansas lignite) is reduced to provide particles sufficiently small to pass through a 3 mesh Tyler screen. The resulting coal is contacted with 300 cc of an aqueous sulfur dioxide solution containing 20 weight percent sulfur dioxide and 200 cc of glacial acetic acid at a pressure of 50 psig, and a temperature of 90° F. for approximately 30 minutes. The treated coal which is comminuted and now contains the calcium values as calcium sulfite and the remaining reagents used in the preceding contacting step, including water, are contacted with a stoichiometric excess of hydrogen sulfide at a temperature of 80° F. and a pressure of 250 psig for approximately 30 minutes to produce water soluble thiosulfate. The resulting coal and an aqueous solution of thiosulfate are separated to recover a treated coal which is suitable for liquefaction and the aqueous phase which is found to contain essentially all of the calcium which was present in the coal feedstock. The resulting treated coal is then slurried with 150 grams of previously extracted asphaltene-free hydrogenated coal solvent boiling in the range from about 300° F. to about 700° F. The slurried coal and 8 grams of hydrogen are charged to a liquefaction zone maintained at a pressure of 2500 psig and a temperature of 785° F. for about 90 minutes. The contents of the coal liquefaction zone are recovered to yield a high quality coal liquefaction product. Since the calcium values present in the original coal feedstock have been removed beforehand, no scale formation is evident on the surface of the vessel utilized for the liquefaction zone.

The foregoing specification and illustrative embodiment clearly indicate the means by which the present invention is effected, and the benefits afforded through the utilization thereof.

I claim as my invention:

1. A process for liquefying a calcium-containing coal feed stock by converting said calcium to a water soluble thiosulfate which comprises:

(a) contacting said calcium-containing coal with a quantity of an aqueous sulfur oxide solution sufficient to convert essentially all of said calcium to the corresponding calcium sulfite;

(b) contacting said coal, water and resultant calcium sulfite admixture from step (a) with a quantity of hydrogen sulfide sufficient to convert said calcium sulfite to the corresponding calcium thiosulfate, which becomes dissolved in said aqueous portion of said admixture;

(c) removing and physically separating said coal of step (b) from the aqueous portion of step (b) containing said calcium as the soluble thiosulfate; and then, (d) liquefying the substantially calcium-free coal derived in step (c) in a liquefaction zone to obtain hydrocarbonaceous products without carbonate scale deposition problems.

2. The process of claim 1 wherein said sulfur oxide is sulfur dioxide.

3. The process of claim 1 wherein the contacting of the coal with the aqueous sulfur oxide solution is conducted at pressures ranging from about 0 to about 3000 psig.

4. The process of claim 1 wherein step (b) is conducted at pressures ranging from about 0 to about 3000 psig.

5. The process of claim 1 wherein the contacting of the coal with the aqueous sulfur oxide solution is maintained for a period at least about 0.01 to about 24 hours.

6. The process of claim 1 wherein step (b) is maintained for a period at least about 0.01 to about 24 hours.

7. The process of claim 1 wherein the coal liquefaction zone is maintained at conditions which include a pressure from about 100 to 300 psig, and a temperature from about 500° to about 850° F.

8. The process of claim 1 wherein the volume ratio of said aqueous sulfur oxide solution to said coal is from about 1 to about 10.

9. The process of claim 1 wherein the hydrogen sulfide of step (b) is present in at least stoichiometric quantity.

10. A process for liquefying a calcium-containing coal feed stock having a particle size of less than five inches in nominal diameter by concomitantly chemically comminutating said coal to a reduced size and converting said calcium to a water-soluble thiosulfate which comprises:

(a) contacting said calcium-containing coal with a quantity of an aqueous sulfur oxide solution sufficient to convert substantially all of said calcium to the corresponding calcium sulfite and with a comminuting agent selected from the group consisting of ammonia, sodium hydroxide, methanol, isopropanol, glacial acetic acid, ethylamine, acetone, hydrogen peroxide and mixtures of said compounds to chemically induce nearly forceless comminuting of said coal to smaller coal particles;

(b) contacting said comminuted coal, water and resultant calcium sulfite from step (a) with a sufficient quantity of hydrogen sulfide to convert said calcium sulfite to the corresponding calcium thiosulfate, which becomes dissolved in said aqueous portion of said admixture;

(c) removing and physically separating said communited coal of step (b) from the aqueous portion of step (b) containing said calcium as the soluble thiosulfate; and then, (d) liquefying said substantially calcium-free coal having a smaller physical size derived in step (c) in a liquefaction zone to obtain hydrocarbonaceous products without carbonate scale deposition problems.

11. The process of claim 10 wherein said sulfur oxide is sulfur dioxide.

12. The process of claim 10 wherein the contacting of the coal with the aqueous sulfur oxide solution and comminuting agent is conducted at pressures ranging from about 0 to about 3000 psig.

13. The process of claim 10 wherein step (b) is conducted at pressures ranging from about 0 to about 3000 psig.

14. The process of claim 10 wherein the contacting of the coal with the aqueous sulfur oxide solution and comminuting agent is maintained for a period at least about 0.01 to about 24 hours.

15. The process of claim 10 wherein step (b) is maintained for a period at least about 0.01 to about 24 hours.

16. The process of claim 10 wherein the coal liquefaction zone is maintained at conditions which include a pressure from about 100 to about 3000 psig, and a temperature from about 500° to about 850° F.

17. The process of claim 10 wherein the volume ratio of said aqueous sulfur oxide solution to said coal is from about 1 to about 10.

18. The process of claim 10 wherein said comminuting agent is present in an amount from about 1 to about 500 weight percent of the coal.

19. The process of claim 10 wherein the hydrogen sulfide of step (b) is present in at least stoichiometric quantity.

* * * * *